US006382629B1

(12) United States Patent
Hill

(10) Patent No.: US 6,382,629 B1
(45) Date of Patent: May 7, 2002

(54) CARD GAME

(76) Inventor: Clarence B. Hill, 47 Clear Creek Ave. #49, Carson City, NV (US) 89701

( * ) Notice: Subject to any disclaimer, the term of this patent is extended or adjusted under 35 U.S.C. 154(b) by 3 days.

(21) Appl. No.: 09/675,736

(22) Filed: Sep. 29, 2000

(51) Int. Cl.[7] ..... A63F 1/00
(52) U.S. Cl. ..... 273/303; 273/292; 273/139; 463/18; 463/20
(58) Field of Search ..... 273/292, 303, 273/139; 463/18, 20

(56) References Cited

U.S. PATENT DOCUMENTS 1,527,929 A * 2/1925 Simons
4,560,171 A * 12/1985 Anthony ..... 273/269
5,092,598 A * 3/1992 Kamille ..... 273/139
5,100,139 A * 3/1992 Di Bella ..... 273/138 R

* cited by examiner

*Primary Examiner*—Jeanette Chapman
*Assistant Examiner*—Dolores R. Collins

(57) ABSTRACT

A card game which is simple and fun, and anyone can play if they can read a standard deck of playing cards. The game is played by multiple players and is similar to "Keno" respectively, as the players try to guess and match the cards that will be drawn. Also, the game can be produced in various versions, such as a home or a casino version, or the game can be played on TV, radio, or the internet.

1 Claim, 2 Drawing Sheets

CARD GAME

FIELD OF THE INVENTION

This invention relates to card games in general but more particularly pertains to a card game which is similar to "Keno". The game is played by either one or multiple players and utilizes a standard 52 card deck, plus 2 joker's for a total of 54 cards. The game further includes at least one ticket for choosing designated cards and tracking means for jackpots and wagering status. The game is strictly a game of chance and no skill is required by the player.

BACKGROUND OF THE INVENTION

Gambling has become very popular over the years, especially recently as there has been a noticeable increase of many additional states which now offer legalized gambling. Card games used in gambling are traditionally limited to "blackjack" also known as 21, "poker" and the like, and such games have been played in the Casinos for many years, therefore unfortunately they are losing their novelty and popularity. While the rules of these games may vary, they are all somewhat similar as in each case the player must be skilled in order to play the game.

Card room poker games are generally played between the players and each player is competing against his fellow players, not against the house. Therefore, casinos have become very popular as many people prefer to win money from an impersonal source, such as the house or the casino, rather than from their fellow players with whom they may be acquainted.

"Keno" is a widely known casino game but it is somewhat limited in use because of many various factors. Such as the cost of the "keno" machine, multiple electronic display boards, the need for many employees to run the game, and the players become impatient due to the lengthy time between games, etc.

It is therefore contended that there is a need for a new type of Card game which can be either played at home, on the radio, on television, or at the casino, etc., and will provide individuals with many hours of recreational fun. It is also important that such a game should be simplistic and easy to learn so that family members of all ages can compete and enjoy the objects of the game together.

SUMMARY OF THE INVENTION

It is therefore an object of the present invention to provide a card game which can be played by an unlimited amount of players at one time.

It is another object of the present invention to provide a simplified card game which can be played by anyone no matter what age they may be, as the game does not require any skill other than choosing a stack of cards.

Another object of the present invention is to provide a card game which is very appealing to casinos, as the odds of winning are highly favorable for the house.

Yet another object of the present invention is to provide a card game which can be played either at home, on a TV or radio show, or at a casino. It is to be noted that in each case the rules may vary as the rules are subject to change respective to the location or media to be used.

Also another object of the present invention is to provide a card game that is simple to play, is non-intimidating, and offers the player an opportunity to win a substantial amount of cash.

A further object of the present invention is to provide simple and very easy to follow instructions including specified abbreviations which independently represent each of the different playing cards.

Another object of the present invention is to provide a novel gambling card game wherein the player wins if a certain amount of chosen cards match the cards in the stack which is picked. Winnings or points will vary according to how many cards are matched in the stack.

It is an object of the present invention to utilize a standard deck of playing cards with two extra Joker cards with the Joker cards being the only two cards allowed to be placed on the same row of a ticket.

It is another object of the present invention to provide a new and exciting card game which incorporates the best features of Poker, Keno, Bingo, etc.

Still another object of the present invention is to provide a card game which does not require additional manufacturing costs, such as specialized machinery or the like.

DETAILED DESCRIPTION OF THE DRAWINGS

Figure 1:
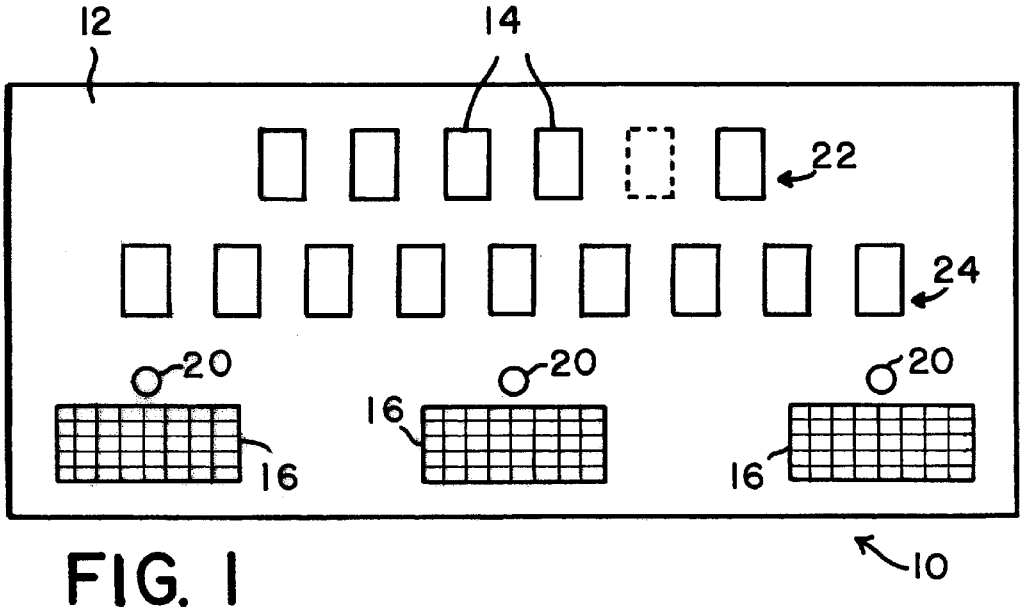
FIG. 1 substantially illustrates a plan view for playing the home version of the card game.
Figure 2:
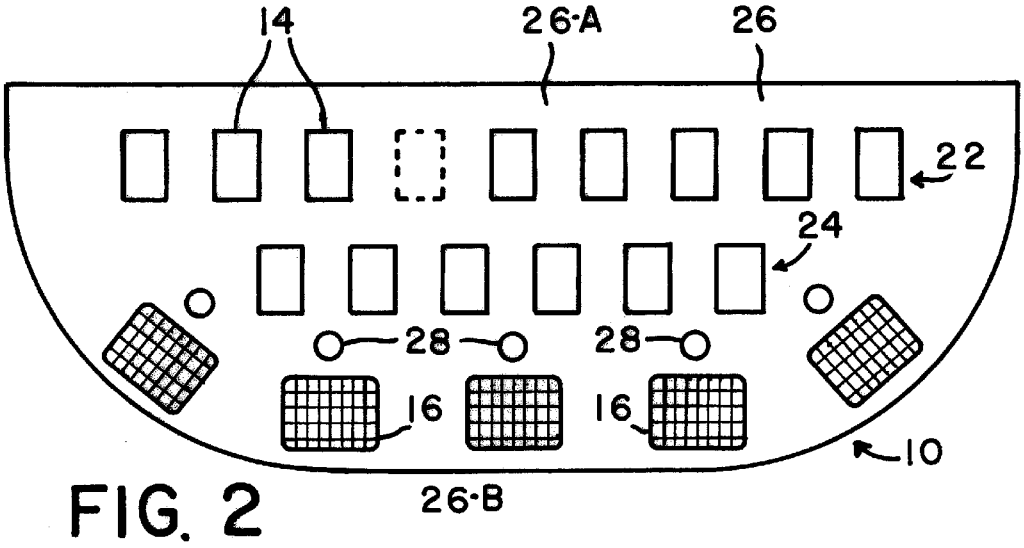
FIG. 2 substantially illustrates a plan view for playing the casino version of the card game.

Referring now in detail to the drawings wherein like characters refer to like elements throughout the various views. In FIGS. 1 & 2, (10) substantially represents an overview of the present invention which is a card game and can be played by any number of players, and anyone who can read a standard deck of playing cards can play.

The card game (10) can be provided in various versions of manufacturing choice, such as the card game (10) can be produced for home or casino use, or the game can be shown and played on other types of media, such as a radio game show, or TV game show, on the internet, lotto, etc.

Therefore I will explain some of the preferred versions within the following specification but it is to be understood the card game (10) is not to be limited to the versions as taught herein but shall include other inherent versions as well.

Referring now to the home version as depicted in FIG. 1, wherein shown is a table (12) which can be any suitable table of players choice that allows the players plenty of space for play and comfort. In this illustration, the table (12) is set up for three players to play, namely the banker, dealer, and the one who picks a stack, but it is to be understood any amount of players can play. Also, in the home version the noted positions shift to dealers left after each draw so that as the game progresses all players will play each position. Also, the duty of each position is, the banker is in charge of the bank, and it is the bankers responsibility to make sure every player has placed their bet before the start of the game and then pay the winners accordingly after the game. The dealers responsibility is to shuffle the deck and then place the cards appropriately (later described) on table (12). The third player's responsibility is to pick one stack of cards.

The game is played with a typical standard deck of 52 playing cards (14) plus 2 jokers for a total of 54 cards. It is to be understood the 2 jokers have no face value and they are not wild, they are treated as just another playing card. The card game (10) further includes a ticket (16) for each player. It is to be understood each player may play as many tickets (16) as they wish, but for simplicity I only show 1 ticket (16) for each player.

Figure 3:
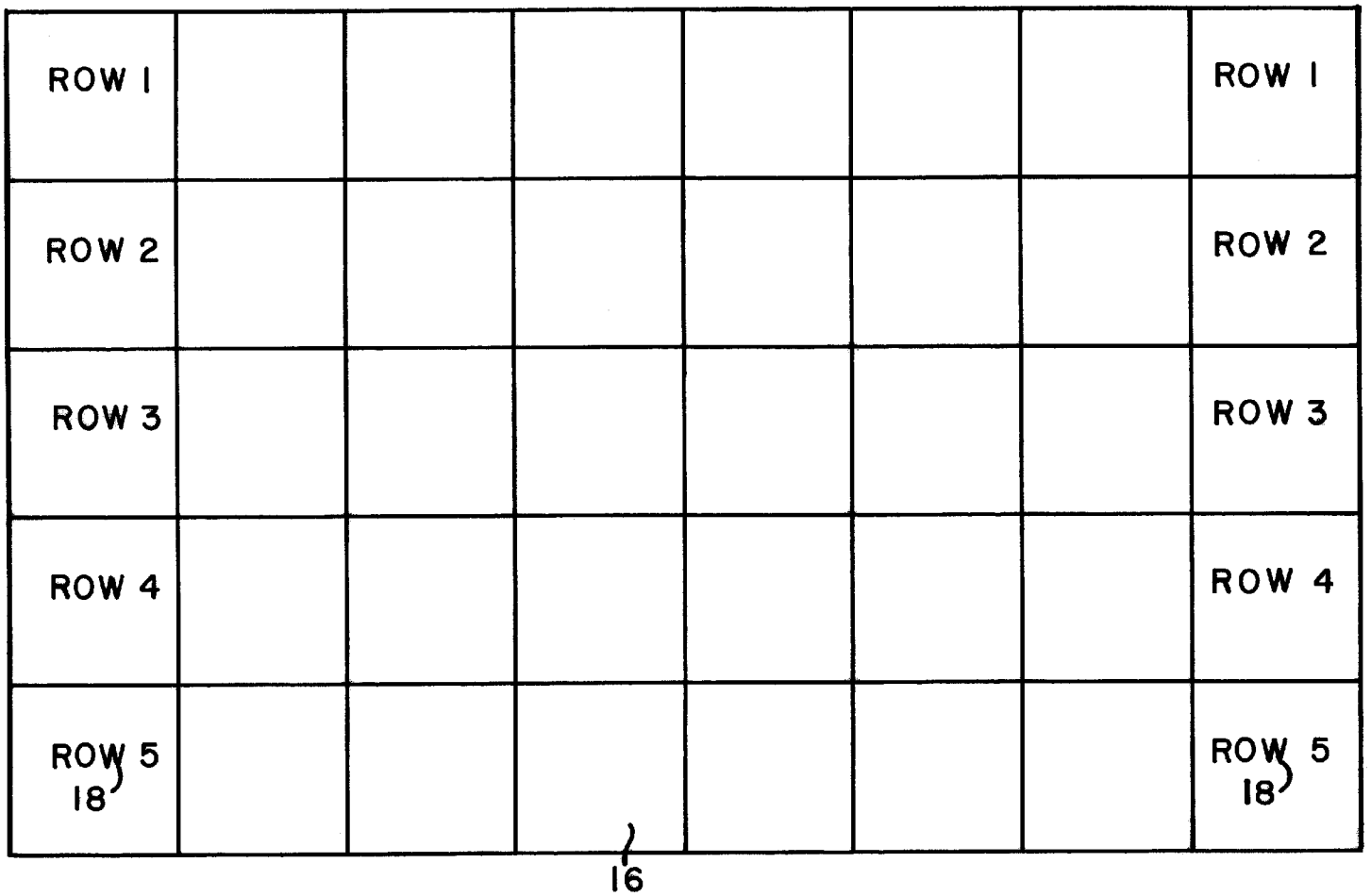
FIG. 3 is substantially an overview for the preferred embodiment for a ticket used in connection with the card game.

The ticket (16) can be arranged in different configurations according to manufacturing choice, thus it is to be understood the following description is only exemplary of one possible configuration which is depicted in FIG. 3. Ticket (16) includes 6 horizontal lines and 9 vertical lines which in combination form a total of 40 squares which are arranged into 5 horizontal rows and 8 vertical rows. In each horizontal row the first square and the last square include indicia (18) therein for identification of that row, such as row 1, row 2, etc. Thus, there are 10 squares having indicia (18) therein and 30 blank squares. It is to be understood in this configuration ticket (16) can be used for five complete consecutive draws, with each horizontal row being used for one draw and five draws equal one game.

To play the home version of card game (10), the players first mark their ticket (16) with abbreviations which represent the cards (14) that they anticipate will be drawn for the game. Or if preferred, the ticket (16) can be previously filled out at the point of manufacture. For example, if a player inserts "JKR" into the first square of horizontal row 1, "KD" into the second square of horizontal row 1, "JC" into the third square of horizontal row 1, "6D" into the fourth square of horizontal row 1, and "AS" into the fifth square of horizontal row 1, it is obvious they have picked the following cards for one draw. The joker, king of diamonds, jack of clubs, 6 of diamonds and ace of spades. It is to be noted, because there are two jokers in the deck both jokers might be drawn during the same game. Therefore, the joker is the only card that can be marked twice on the ticket (16) in one row. It is to be noted every card in the 54 card deck can be represented by one of the abbreviations, with each abbreviation using three or less characters.

The rules of the game are as follows:

a. all players agree to a pay scale that is acceptable. For example, a suitable pay scale may include three correct cards equal three chips (20), four correct cards equal five chips (20), five correct cards equal ten chips (20), six correct cards wins the jackpot;

b. the game is played with a deck of 54 playing cards including a standard 52 card deck of playing cards plus two additional Jokers;

c. the game includes at least one ticket (16) for each of the players, with the ticket having five horizontal rows, with each horizontal row being used for one draw and five draws equal one game;

d. each player marks at least one ticket with abbreviations which correspond to the cards (14) they anticipate will be drawn;

e. each player places their bet. It is to be noted before the first draw each player bets ten chips (20), and during the second through the fourth draw each player bets one chip (20). It is to be further noted that the "bet" can be in the form of chips, money, or any other suitable object of choice;

f. the dealer shuffles the deck and then positions the cards (14) on table (12) face-down one at a time into six different stacks (22) with each stack having nine cards, thus all 54 cards are used for each draw;

g. the third player namely "the player who chooses the stack" identifies to the dealer which one of the six stack's (22) they wish to be the draw. Please note within FIG. 1 the stack which was picked is shown in ghost lines;

h. the dealer picks up the identified stack and places each of the cards from that stack one at a time face up substantially side-by-side, until all nine cards (24) are displayed face up. Therefore, all nine cards (24) in combination are considered to be the draw;

i. the banker determines if there is a winner, pays the winner accordingly, and gathers the losers chips for addition to the jackpot. It is to be noted if three or more cards (14) from the draw match three or more of the abbreviations on row one of any players ticket (16) that player is a winner;

j. repeat steps e–i until four consecutive draws have been played;

k. for the fifth draw and finish of the game, the dealer shuffles the deck and then positions the cards (14) on table (12) face-down one at a time into six different stacks (22) with each stack having nine cards;

l. the dealer then turns over one of the stacks and distributes the stack as defined in step "h";

m. if one player has six abbreviations on row 5 that match the cards on display, that player wins the jackpot, if more than one player wins, the winners split the jackpot;

n. if there are no winners, then the dealer continues to pick up the remaining stacks one at a time until there is a winner.

It will now be seen I have provided a version of the card game (10) which can be played at home, and which is fun and very entertaining.

As stated earlier, another version of the game can be played at a casino. It is to be understood that the casino version may be constructed in a manner similar to "Keno" or the like. Thus having display boards, tickets, a counter, and electronics for control of pay-outs, etc. Also the tickets may include only one horizontal row or multiple horizontal rows but each row is considered one game, and the chips (20) have a designated dollar value, depending on what is appealing to the particular casino.

Therefore the following description is only exemplary for one possible means of playing the card game (10) which is similar to the home version but varies slightly as described within the specification as follows:

In FIG. 2 is depicted the casino version of card game (10) wherein (26) represents a card table having a dealers side (26-A), a players side (26-B), designated space for the players tickets (16), designated betting area (28), space for placement of the cards (14), and seating arrangements for each of the players.

The casino version may be played as follows:

a. The casino determines a proper pay scale that is acceptable. For example, a suitable pay scale may include three correct cards equal three chips (20), four correct cards equal five chips (20), five correct cards equal ten chips (20), six correct cards wins the jackpot;

b. the casino providing a deck of 54 playing cards comprising a standard 52 card deck of playing cards plus two additional Jokers;

c. the casino providing at least one ticket (16) for each of the players, with the ticket (16) comprising any number of horizontal rows, with each horizontal row being one game;

d. each player marks abbreviations, as previously described, on at least one ticket (16);

e. each player places their bet with the minimum bet being determined by the casino. It is to be noted that the "bet" can be in the form of casino chips having a dollar value, or money, etc.; with each bet being determined by how many tickets the player is playing;

f. the dealer shuffles the deck of 54 playing cards and then positions the cards (14) on table (12) face-down one at a time into nine different stacks (22) with each stack having six cards, thus all 54 cards are used for each game;

g. the dealer asks one of the players if they wish to be the one to choose the stack, if they agree then they identify to the dealer which one of the nine stack's (22) they wish to be the draw for that game, "note within FIG. 2 the stack which was picked by the player is shown in ghost lines";

h. the dealer picks up the identified stack and places each of the cards from that stack one at a time face up substantially side-by-side, until all six cards (24) are displayed face up, therefore all six cards (24) in combination are considered to be the draw for the game; and;

i. the dealer determines if there is a winner, pays the winner accordingly, and gathers the losers chips for either addition to a jackpot or addition to the casinos funds, depending on the casinos preference, it is to be noted if three or more cards (14) from the draw match three or more of the abbreviations on row one of any players ticket (16) that player is a winner for that game.

As stated before other types of media such as radio and TV shows may also provide the game for play, or the game may be available on the internet. Whereby the rules are substantially the same as the casino rules, but rather than providing chips (20), it is preferred that money or merchandise be used as the reward for winners.

It can now be seen I have herein provided a new and novel card game which can be played by numerous players, and can be produced in various versions, such as for home use, TV, radio, casino, etc.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described the invention what I claim as new and wish to secure by Letters Patent is:

1. A method of playing a card game comprising the steps of:

a. the house determining a proper pay scale that is acceptable;

b. providing a deck of 54 playing cards comprising a standard 52 card deck of playing cards including two Jokers;

c. providing at least one ticket for each of the players, said ticket comprising any number of horizontal rows, with each horizontal row being one game;

d. each of said players marking abbreviations on at least one ticket;

e. each of said players placing their bet, with the minimum bet being determined by said house; said bet is in the form of either house chips having a dollar value, or money, said bet being determined by how many tickets the player is playing;

f. the dealer shuffling said deck of 54 playing cards and positioning said cards on a table face-down one at a time into nine different stacks with each of said nine different stacks having six of said cards, thus all 54 of said cards are used for each game;

g. said dealer asking one of said players if they wish to be the one to choose the stack, if they agree then they identify to said dealer which stack of said nine different stacks they wish to be the draw for said game;

h. said dealer picking up said stack of said nine different stacks and placing each of said cards from said stack of said nine different stacks one at a time face up substantially side-by-side, until all said six of said cards of said stack of said nine different stacks are displayed face up, said six of said cards of said stack of said nine different stacks in combination are considered to be said draw for said game; and;

i. said dealer determining if there is a winner, pays said winner accordingly and gathering the losers chips for either addition to a jackpot or for addition to house funds, if three or more of said cards from said draw match three or more of said abbreviations on at least one row of any said players said ticket, that player is a winner for said game.

* * * * *